US006905561B2

(12) United States Patent
Jones et al.

(10) Patent No.: US 6,905,561 B2
(45) Date of Patent: Jun. 14, 2005

(54) SOLID ROCKET PROPELLANT

(75) Inventors: Marvin Luther Jones, Hollister, CA (US); Donald Dongjaw Tzeng, San Jose, CA (US)

(73) Assignee: United Technologies Corporation, Hartford, CT (US)

( * ) Notice: Subject to any disclaimer, the term of this patent is extended or adjusted under 35 U.S.C. 154(b) by 523 days.

(21) Appl. No.: 09/730,684

(22) Filed: Dec. 6, 2000

(65) Prior Publication Data

US 2002/0029829 A1 Mar. 14, 2002

Related U.S. Application Data

(62) Division of application No. 09/356,175, filed on Jul. 16, 1999, now Pat. No. 6,238,499.

(51) Int. Cl.[7] ..... C06B 45/10; D03D 23/00
(52) U.S. Cl. ..... 149/19.4; 149/124
(58) Field of Search ..... 149/124, 19.4

(56) References Cited

U.S. PATENT DOCUMENTS 3,798,090 A * 3/1974 Allabashi ..... 149/19.4
4,018,636 A * 4/1977 O'Neill et al. ..... 149/19.4
4,057,442 A * 11/1977 Shaw et al. ..... 149/19.92
4,229,182 A * 10/1980 Frosch ..... 149/19.4
4,390,566 A * 6/1983 Umezawa et al. ..... 427/198
4,415,728 A * 11/1983 Tremblay ..... 149/19.4
4,569,973 A * 2/1986 Tyrell et al. ..... 525/437
4,775,432 A * 10/1988 Kolonko et al. ..... 149/19.4
4,853,051 A * 8/1989 Bennett et al. ..... 149/19.4
5,120,790 A * 6/1992 Yu ..... 525/186
5,190,533 A * 3/1993 Blackburn ..... 604/367
5,994,478 A * 11/1999 Asrar et al. ..... 525/437
6,238,499 B1 * 5/2001 Jones et al. ..... 149/19.4
6,395,859 B1 * 5/2002 Stern et al. ..... 149/19.4
6,576,072 B2 * 6/2003 Chan et al. ..... 149/19.2

* cited by examiner

*Primary Examiner*—Aileen Felton
(74) *Attorney, Agent, or Firm*—George J. Romanik; Tracey R. Loughlin

(57) ABSTRACT

A solid rocket propellant includes a hydroxy-terminated caprolactone ether binder and an oxidizer. The propellant may be disposed of by contacting it with an aqueous solution of 12 N NaOH or 6 N HCl at a temperature of about 140° F. for about 24 hours to decompose the binder. Solids remaining in the solution after the binder decomposes are removed.

6 Claims, No Drawings

SOLID ROCKET PROPELLANT

This is a division copending application Ser. No. 09/356,175 filed on Jul. 16, 1999 now U.S. Pat. No. 6,238,499.

TECHNICAL FIELD

The present invention is directed to a solid rocket propellant.

BACKGROUND ART

Solid rocket propellants typically comprise an oxidizer, a fuel, a variety of additives, and a binder that holds the propellant together. Typical oxidizers include ammonium nitrate, ammonium dinitramide, ammonium perchlorate, potassium perchlorate, and other compounds known in the art. Typical fuels include aluminum powder, boron, and beryllium. Typical binders include nitrocellulose, hydroxy terminated polybutadiene, butadiene terpolymer, polybutadiene-acrylic acid-acrylonitrile, carboxyl terminated polybutyldiene, polyesters, polyethylene glycol, poly tetramethylene glycol and other compounds known in the art. Typical additives include plasticizers such as n-butyl nitratoethyl nitramine, trimethylolethane trinitrate and isodecyl pelargonate, dioctyl adipate; burning rate modifiers such as iron oxide and carbon; combustion stabilizers such as zirconium oxide; anti-oxidants such as n-methyl nitroaniline and 2,2"-Methylene-Bis-(4-Methyl-6-Tert-Butylphenol) (available as AO-2246 from American Cyanamid Company, Parsippany, N.J.); curing agents such as dimeryl diisocyante, isophorone diisocyanate, and Desmodur® N-100 (available from Bayer Corporation, Pittsburgh, Pa.); curing catalysts such as triphenyl bismuth and dibutyltin dilaurate; and acoustic suppressants such as silicon carbide.

Solid rocket propellants can be tailored to specific applications by varying their formulations. Although preliminary work on new formulations can be done in a laboratory with small quantities, testing and large scale demonstrations are typically required before a new formulation is accepted for military or commercial use. As a result, propellant development programs often generate considerable excess inventory of propellant. Production programs also generate excess inventory or off specification material. Finally, excess propellant is generated when rocket motors are periodically remanufactured to replace aging propellant with fresh propellant. In all cases, the excess inventory or off-specification material must be disposed of safely. Historically, open air incineration was the preferred disposal method. Increasingly, however, open air incineration is becoming environmentally unacceptable. Therefore, what is needed in the industry is a solid rocket propellant that can be disposed of with environmentally acceptable techniques.

DISCLOSURE OF THE INVENTION

The present invention is directed towards a solid rocket propellant that can be disposed of with environmentally acceptable techniques. As a side benefit, main components of the propellant can be recovered for reuse.

One aspect of the invention includes a solid rocket propellant that includes a hydroxy-terminated caprolactone ether binder.

Another aspect of the invention includes a method of disposing of a solid rocket propellant. A solid rocket propellant that includes a hydroxy-terminated caprolactone ether binder and one or more solid compounds disposed in the binder is contacted with a solution capable of hydrolyzing the binder to binder to form hydrolyzed caprolactone and poly(tetramethylene ether),. Solids remaining in the solution after the binder hydrolyzes are removed.

These and other features and advantages of the present invention will become more apparent from the following description.

BEST MODE FOR CARRYING OUT THE INVENTION

The present invention includes a full range of solid rocket propellant formulations, including minimum smoke propellants, reduced smoke propellants, and metalized propellants. The common element in all aspects of the present invention is the use of a hydroxy-terminated caprolactone ether (HTCE) polymer as a binder to hold the solid constituents of the propellant of the present invention together. As a result, the propellant of the present invention comprises at least one solid compound, for example an oxidizer, dispersed in an HTCE binder. For purposes of this application, HTCE is a linear block co-polymer of caprolactone and tetramethylene ether. Preferably, HTCE will have a molecular weight of about 2000 units to about 4200 units. At typical HTCE may have an OH value of about 56 mg KOH/g an acid value of less than about 0.1 mg KOH/g, and a melting range of about 86° F. to about 95° F. The preferred HTCE is a waxy solid at room temperature and is a liquid at typical propellant processing temperatures of 120° F. to 140° F. HTCE is commercially available from Solvay Interox, Inc. (Houston Tex.) as part of Solvay's CAPA® line of polycaprolactones. The HTCE binder may make up about weight 4 weight % to about 10 weight % of the propellant of the present invention.

Minimum smoke propellants of the present invention include an HTCE binder and a chlorine-free oxidizer. Suitable chlorine-free oxidizers include ammonium nitrate (AN), ammonium dinitramide (ADN), nitramines such as cyclotrimethylene trinitramine (RDX) and cyclotetramethylene tetranitramine (HMX), and other chlorine-free oxidizers known in the art. A minimum smoke propellant may comprise about 45 weight % to about 75 weight % of the oxidizer. If desired, the propellant also may include one or more nitrate ester plasticizers such as n-butyl nitratoethyl nitramine (BuNENA), trimethylol ethane trinitrate (TMETN) triethylene glycol dinitrate (TEGDN), and other nitrate ester plasticizers known in the art for additional energy. Plasticizers may make up about 6 weight % to about 18 weight % the minimum smoke propellant. Minimum smoke propellants of the present invention may have a theoretical specific impulse of more than 230 $lb_f$ sec/$lb_m$ with an AN oxidizer and more than 260 $lb_f$ sec/$lb_m$ with an ADN oxidizer. Such propellants may be useful in tactical applications where a visible exhaust is undesirable because it would expose a rocket's firing position.

Reduced smoke propellants of the present invention include an HTCE binder and a chlorinated oxidizer. Suitable chlorinated oxidizers include ammonium perchlorate (AP), which may make up about 65 weight % to about 86 weight % of a reduced smoke propellant. If desired, the propellant also may include one or more energetic plasticizers such as BuNENA, TMETN, and TEGDN or fuel plasticizers such as dioctyl adipate (DOA) or isodecyl pelargonate (IDP). Plasticizers may make up about 5 weight % to about 12 weight % of the reduced smoke propellant. Reduced smoke propellants of the present invention may have a theoretical specific impulse of more than 244 $lb_f$ sec/$lb_m$ with an AP oxidizer. Such propellants may be useful in tactical applications, such a air-to-air applications, where a small amount of visible exhaust is tolerable as long as the exhaust does not obscure an operator's field of view.

Metalized propellants of the present invention include an HTCE binder, metal fuel, and an oxidizer. Suitable metal fuels include aluminum, boron, and other metal fuels known in the art. The preferred metal fuel is aluminum. The metal fuel may make up about 15 weight % to about 24 weight % of the metalized propellant. Suitable oxidizers include AP, AN, ADN, HMX, RDX, and other oxidizers known in the art. The oxidizer may make up about 45 weight % to about 75 weight % of the metalized propellant. If desired, the propellant also may include one or more energetic plasticizers, such as TMETN or TDGDN, or fuel plasticizers, such as DOA or IDP. Plasticizers may make up about 5 weight % to about 12 weight % of metalized propellants of the present invention. Metalized propellants of the present invention may have a theoretical specific impulse of more 263 $lb_f$ sec/$lb_m$ with AP oxidizer and 268 $lb_f$ sec/$lb_m$ with ADN or HMX oxidizer. Such propellants may be useful in applications for which high energy content is desirable and for which visible exhaust is not a problem.

The HTCE binder of the present invention can be cured with a variety of curing agents including di-functional isocyanates such as isophorene diisocyante (IPDI), dimeryl diisocyanate (DDI), bis-(4,isocyanatocyclohexyl) methane (Desmodur®-W, available from Bayer Corporation, Pittsburgh, Pa.), and other di-functional isocyanates; and poly-functional isocyanates such as aliphatic isocyanates made by the homo-polymerization of hexamethylene diisocyanate, including Desmodur® N-100 and Desmodur® N-3200 (both available from Bayer Corporation), and other poly-functional isocyanates. The curing agent may make up as much as about 2.75 weight % of the propellant. A cross-linker may be desirable when di-functional isocyanates are use as curing agents. Preferable cross-linkers include tri-functional and tetra-functional hydroxy terminated caprolactones, such as CAPA® 310 and CAPA® 316 (available from Solvay Interox, Inc.). The cross-linker may make up as much as about 2.0 weight % of the propellant of the present invention. A cure catalyst such as triphenyl bismuth (TPB), dibutyltin dilaurate (DBTDL), or similar cure catalysts may be used to speed the cure reaction. Typical amounts of TPB in the propellant range from about 0.01 weight % to about 0.05 weight %. Typical amounts of DBTDL range from about 1 PPM by weight to about 6 PPM by weight. HTCE may be cured under conditions typically used in the industry. For example, HTCE may be cured at temperatures of about 120° F. to about 140° F. for times ranging from 3 days to 2 weeks.

The propellant of the present invention also may include stabilizers, acoustic suppressants, burner rate modifiers, and other additives. For example, propellants of the present invention may include up to about 0.5 weight % of one or more stablizers, such as N-methyl-ρ-nitroanaline (NMNA), 2-nitro diphenylamine DPA), or other stabilizers known in the art, to extend their useful lives. Stablizers may be particularly useful in propellants that contain nitrate ester plastizers. The propellants also may include up to about 0.5 weight % of an acoustic suppressants such as silicon carbide or zirconium carbide. Burn rate modifiers, such as carbon black and/or lead compounds including lead citrate, may be included in the propellant of the present invention in amounts up to about 0.2 weight %. Iron oxide can be used as a burning rate modifier in formulations without energetic nitrate ester plasticizers in amounts up to about 2 weight %.

By varying the formulation, burn rates for the propellant of the present invention may be tailored for numerous applications. Burning rates have been observed as low as 0.18 in/sec and as high as 0.34 in/sec at 1000 psi for formulations without any burning rate modifiers. Pressure exponents were between 0.3 and 0.4. The ranges of burning rates and pressure exponents may be expanded by using various additives and curing catalysts discussed above. It should be possible to formulate metalized propellants with iron oxide burning rate catalyst that have burning rates as high as 0.75 in/sec at 1000 psi.

The mechanical properties of the HTCE binder, such as modulus, tensile strength, and elongation, also may be tailored for particular applications. For example, the modulus may be varied from about 300 psi to about 700 psi, the tensile strength may be varied from about 75 psi to about 150 psi, and the elongation may be varied from about 30% to about 150% of the propellant of the present invention. One way to adjust the mechanical properties of the binder is to vary the isocyanate/hydroxyl (NCO/OH) equivalent ratio. For example, the NCO/OH equivalent ratio may be varied from about 0.95 to about 1.20. Another method is to add about 0.1 weight % to about 2.0 weight % of a tri-functional or tetra-functional hydroxyl-terminated caprolactone to the formulation as a cross-linker in the propellant. The cross-linker promotes cross-linking within the HTCE co-polymer structure. Suitable cross-linkers include tri-functional and tetra-functional hydroxy terminated caprolactones, such as CAPA® 310 and CAPA® 316 (available from Solvay Interox, Inc.).

Once a specific formulation is chosen, the ingredients are mixed in an explosion proof mixing vessel according to industry practices to create an uncured propellant. The uncured propellant may be loaded into a rocket casing or other container by known casting techniques and cured under suitable conditions. For example, the propellant of the present invention may be cured at temperatures of about 120° F. to about 140° F. It may take about 3 days to about 14 days to cure a batch of propellant of the present invention. Samples of the cured propellant may then be tested to confirm the properties. The final product would then be ready to deliver to the customer.

Over time, quantities of propellant that require disposal may be accumulated as a result of off-specification mixing, excess production, natural degradation of the propellant, obsolescent propellant or missiles being removed from service, and similar events. In the past, such propellant was typically disposed of by open air incineration. Propellants of the present invention, however, may be disposed of by hydrolyzing the HTCE binders in the propellant. The ester linkage in the caprolactone in the HTCE binder provides the site for hydrolysis. The polyether linkage in the HTCE binders increase the hydrophilicity of the cured binder toward aqueous acidic and/or basic solutions. Thus, the polyether linkage is more resistant to hydrolysis that the ester linkage.

To dispose of propellant of the present invention by hydrolysis, the propellant may be reduced in size to facilitate handing and increase surface area for the reaction. While no particular size reduction is required, preferably the propellant will be reduced to pieces of no more than about 0.5 inch in any dimension. The propellant is then mixed with a solution capable of hydrolyzing HTCE. For example, HTCE may be hydrolized in an acidic aqueous solution of 6 N HCl (hydrochloric acid) or a basic aqueous solution of 12 N NaOH (sodium hydroxide). One skilled in the art will recognize that solutions with different compositions and concentrations would work as well. Preferable, the hydrolysis will be conducted at an elevated temperature, for example about 140° F., for a sufficient time to completely hydrolyze the HTCE. Agitation can speed the hydrolysis reaction. By selecting appropriate conditions, hydrolysis can be completed within about 24 hours. As a result of the hydrolysis reaction, the HTCE binder will decompose into water soluble, environmentally benign compounds such as hydrolyzed caprolactone, typically ω-hydroxyl caproic acid, and poly(tetramethylene ether) that may be recycled. Solids that were in the propellant, for example the oxidizer and other solids, may be recovered and recycled for use in other propellants. Aluminum may be recovered as aluminum oxide. The ability to recover and reuse the solids, which may make up 85 weight % or more of the propellant, greatly reduces the environmental impact of disposing of propellants of the present invention. The residue of hydrolysis that cannot be recycled may be disposed of in a suitable landfill without any environmental harm.

The following examples demonstrates the present invention without limiting the invention's broad scope.

EXAMPLE 1

To demonstrate the present invention, several propellants were formulated using a HTCE binder. The table shows the compositions, mechanical properties, and wherein available burning rate and pressure exponent data.

TABLE

| | Propellant A Metalized | Propellant B Metalized | Propellant C Reduced Smoke |
|---|---|---|---|
| HTCE binder (MW = 2000) | 8.80 | 4.21 | 6.21 |
| CAPA ® 316 cross-linking agent | 0.18 | 1.05 | 1.04 |
| Diocytal adipate (DOA) plasticizer | 4.84 | | |
| n-butyl nitratoethyl nitramine (BuNENA) plasticizer | | 15.54 | 10.65 |
| n-methyl nitroanaline (NMNA) stabilizer | | 0.50 | 0.50 |
| triphenyl bismuth (TPB) cure catalyst | 0.05 | 0.05 | 0.05 |
| silicon carbine (SiC) acoustic suppressant | | | 0.50 |
| carbon (C) black burning rate modifier | | | 0.20 |
| dimeryl diisocyante (DDI) curing agent | 3.13 | 2.50 | 3.40 |
| ammonium perchlorate (AP) oxidizer | 63.00 | 56.00 | 77.20 |
| aluminum (Al) fuel | 20.00 | 20.00 | |
| modulus, psi | 623 | 100 | 383 |
| tensile strength, psi | 92 | 29 | 45 |
| elongation, failure % | 65 | 43 | 20 |
| burning rate, in/sec @ 1000 psi | | 0.28 | 0.26 |
| pressure exponent | | 0.39 | 0.36 |

EXAMPLE 2

A 2.0-gram sample of cured HTCE gum stock was cut into small pieces of no more than 0.5 inch in any dimension. The cut pieces were placed in a beaker containing 50-ml of 12 N NaOH aqueous solution. The solution was stirred with a magnetic stirrer and heated on a hot plate. The reaction temperature was kept at 60° C. At the end of reaction, about 24 hours, all solid gum stock dissolved and some oil droplet suspension was visible. These results indicate that the HTCE binder may be hydrolyzed as part of a method of disposing of a propellant of the present invention.

The invention is not limited to the particular embodiments shown and described herein. Various changes and modifications may be made without departing from the spirit or scope of the claimed invention.

We claim:

1. A method of disposing of a solid rocket propellant, comprising the steps of:

(a) contacting a propellant that comprises a hydroxy-terminated caprolactone ether (HTCE) binder and at least one or more solid compounds dispersed in the binder with a solution capable of hydrolyzing the binder to form hydrolyzed caprolactone and poly (tetramethylene ether), and (b) removing solids remaining in the solution after the binder hydrolyzes.

2. The method of claim 1, wherein the solids are recovered and recycled.

3. The method of claim 1, wherein the hydrolyzed caprolactone and the poly(tetramethylene ether) are recovered and recycled.

4. The method of claim 1, wherein at least one solid compound comprises an oxidizer that comprises ammonium nitrate, ammonium dinitramide, cyclotrimethylene trinitramide, or cyclotetramethylene tetranitramine and the propellant further comprises a plasticizer that comprises n-butyl nitratoethyl nitramine, trimethylol ethane trinitrate, or triethyleneglycol dinitrate, wherein the propellant comprises about 4 weight % to about 10 weight % HTCE binder, about 45 weight % to about 75 weight % oxidizer, and about 6 weight % to about 18 weight % plasticizer.

5. The method of claim 1, wherein at least one solid compound comprises an oxidizer that comprises ammonium perchlorate and the propellant further comprises a plasticizer that comprises n-butyl nitratoethyl nitramine, trimethylol ethane trinitrate, triethyleneglycol dinitrate, dioctyl adipate, or isodecyl pelargonate wherein the propellant comprises about 4 weight % to about 10 weight % HTCE binder, about 65 weight % to about 86 weight % oxidizer, and about 5 weight % to about 12 weight % plasticizer.

6. The method of claim 1, wherein at least one solid compound comprises an oxidizer that comprises ammonium perchlorate, ammonium nitrate, ammonium dinitramide, cyclotrimethylene trinitramide, or cyclotetramethylene tetranitramine and further comprises an aluminum or boron metal fuel and a plasticizer that comprises trimethylol ethane trinitrate, triethyleneglycol dinitrate, dioctyl adipate, or isodecyl pelargonate wherein the propellant comprises about 4 weight % to about 10 weight % HTCE binder, about 45 weight % to about 75 weight % oxidizer, about 15 weight % to about 24 weight % metal fuel and about 5 weight % to about 12 weight % plasticizer.

* * * * *